US011702892B2

(12) United States Patent
Whitney et al.

(10) Patent No.: US 11,702,892 B2
(45) Date of Patent: Jul. 18, 2023

(54) DISCONNECT DEVICE

(71) Applicant: Coretrax Americas Ltd., Houston, TX (US)

(72) Inventors: Tyler Whitney, Houston, TX (US); Alessandro Caccialupi, Houston, TX (US); Scott Benzie, Houston, TX (US)

(73) Assignee: Coretrax Americas Limited, Houston, TX (US)

( * ) Notice: Subject to any disclaimer, the term of this patent is extended or adjusted under 35 U.S.C. 154(b) by 0 days.

(21) Appl. No.: 17/376,094

(22) Filed: Jul. 14, 2021

(65) Prior Publication Data

US 2022/0018193 A1 Jan. 20, 2022

Related U.S. Application Data

(60) Provisional application No. 63/051,689, filed on Jul. 14, 2020.

(51) Int. Cl.
*E21B 17/02* (2006.01)

(52) U.S. Cl.
CPC ..... *E21B 17/021* (2013.01)

(58) Field of Classification Search
CPC ..... E21B 17/02; E21B 23/042
See application file for complete search history.

(56) References Cited

U.S. PATENT DOCUMENTS 3,712,376 A * 1/1973 Owen ..... E21B 23/04 166/380
3,948,321 A * 4/1976 Owen ..... E21B 23/04 166/207
4,009,753 A * 3/1977 McGill ..... E21B 34/045 166/55.1
4,325,434 A * 4/1982 Roberts ..... E21B 34/045 166/324
8,141,634 B2 * 3/2012 Fisher ..... E21B 17/06 166/242.6
10,066,447 B2 * 9/2018 Thomas ..... E21B 17/06
2008/0041597 A1 * 2/2008 Fisher ..... E21B 23/14 166/381
2010/0319930 A1 * 12/2010 Evans ..... E21B 17/023 166/377
2012/0090849 A1 * 4/2012 Stanford ..... E21B 17/06 166/323
2013/0309016 A1 * 11/2013 McKee ..... E21B 17/06 405/170
2014/0110129 A1 * 4/2014 Schmidt ..... E21B 23/04 166/242.6
2015/0136394 A1 * 5/2015 Turley ..... E21B 23/00 166/382
2015/0218906 A1 * 8/2015 Clem ..... E21B 43/04 166/321
2016/0362967 A1 * 12/2016 Mullins ..... E21B 33/14

* cited by examiner

*Primary Examiner* — Shane Bomar
(74) *Attorney, Agent, or Firm* — Tumey L.L.P.

(57) ABSTRACT

A disconnect device for use as part of a downhole assembly in an oil or gas well. In one embodiment, the device comprises a lower receptacle assembly comprising a recess profile; an upper assembly comprising: a shaft comprising a fluid passage, a collet comprising collet fingers, a piston, a cylinder assembly, a pressure chamber disposed radially between the shaft and the cylinder assembly, and a spring, wherein the piston is selectively movable into three positions.

4 Claims, 2 Drawing Sheets

DISCONNECT DEVICE

CROSS-REFERENCE TO RELATED APPLICATIONS

This application is a non-provisional application that claims the benefit of U.S. Provisional Application Ser. No. 63/051,689 filed on Jul. 14, 2020, the disclosure of which is incorporated by reference herein in its entirety.

STATEMENT REGARDING FEDERALLY SPONSORED RESEARCH OR DEVELOPMENT

Not applicable.

BACKGROUND OF THE INVENTION

Field of the Invention

The present invention relates to a disconnect device for use in an oil and/or gas well. More particularly, the present invention relates to, without limitation, a disconnect device suitable for use in a workstring that may be capable of releasing a bottomhole assembly (BHA) from the workstring in a controlled fashion.

Background of the Invention

Various systems and methods have been proposed and utilized for disconnecting or releasing BHAs and other tools from workstrings and other tubing strings in a well during drilling, well workover, and well intervention, including some of the systems and methods in the references appearing on the face of this patent. However, those systems and methods lack all the features or steps of the systems and methods covered by any patent claims below. As will be apparent to a person of ordinary skill in the art, any systems and methods covered by claims of the issued patent solve many of the problems that prior art systems and methods have failed to solve. Also, the systems and methods covered by the at least some of the claims of this patent have benefits that could be surprising and unexpected to a person of ordinary skill in the art based on the prior art existing at the time of invention.

BRIEF SUMMARY OF SOME OF THE PREFERRED EMBODIMENTS

These and other needs in the art are addressed in one embodiment by a disconnect device for use as part of a downhole assembly in an oil or gas well which comprises: a lower receptacle assembly comprising a recess profile; an upper assembly comprising: a shaft comprising a fluid passage, a collet comprising collet fingers, a piston, a cylinder assembly, a pressure chamber disposed radially between the shaft and the cylinder assembly, and a spring, wherein the piston is selectively movable into three positions.

These and other needs in the art are addressed in one embodiment by A method for disconnecting a disconnect device for use as part of a downhole assembly in an oil or gas well comprising: (A) outfitting a downhole assembly with a disconnect device comprising: a lower receptacle assembly comprising a recess profile; and an upper assembly comprising: a shaft comprising a fluid passage, a collet comprising collet fingers, a piston, a cylinder assembly, a pressure chamber disposed radially between the shaft and the cylinder assembly, and a spring, wherein the piston is disposed radially between the shaft and the collet such that the collet fingers are engaged with the recess profile, and wherein the piston is coupled to the cylinder assembly via at least one shear pin; (B) applying an actuating pressure within the fluid passage and the pressure chamber to a pressure level capable of shearing the at least on shear pin to free the piston for displacement; (C) lowering the pressure level in the pressure chamber by releasing pressure; (D) allowing the piston to be displace to a position radially between the shaft and the cylinder assembly, wherein the collet fingers are not engaged with the recess profile; and (E) disconnecting the lower receptacle assembly from the upper assembly.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments. In the following description of the representative embodiments of the invention, directional terms, such as "above," "below," "upper," "lower," etc., are used for convenience in referring to the accompanying drawings. In general, "above," "upper," "upward" and similar terms refer to a direction towards the earth's surface along a wellbore, and "below," "lower,"

"downward" and similar terms refer to a direction away from the earth's surface along the wellbore.

Figure 1:
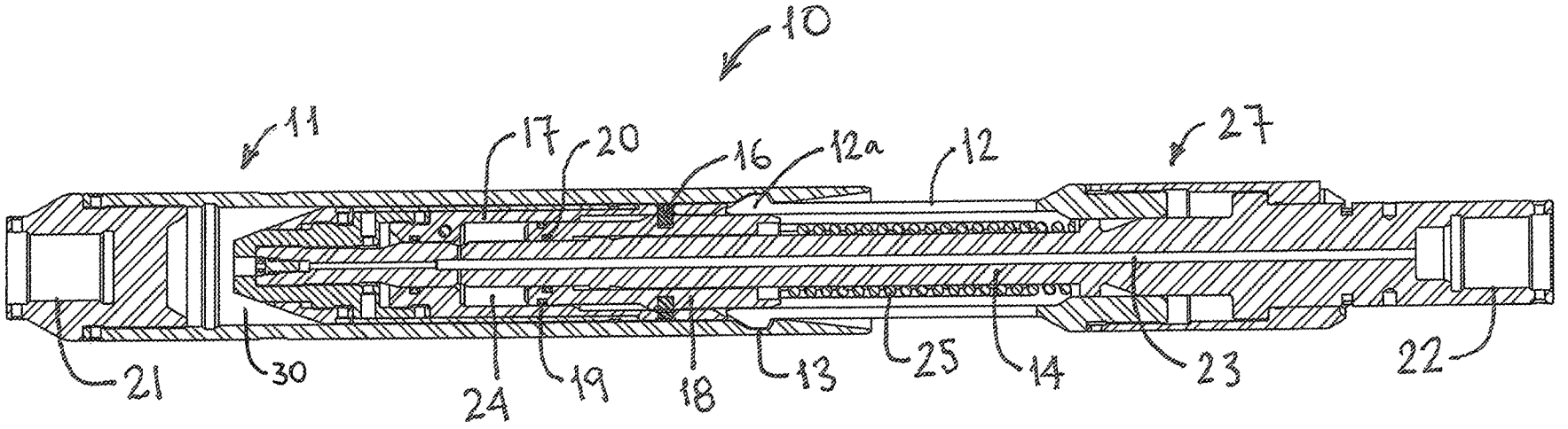
FIG. 1 illustrates a longitudinal, cross-sectional view of a disconnect device according to an embodiment of the present invention in an initial coupled state.
Figure 2:
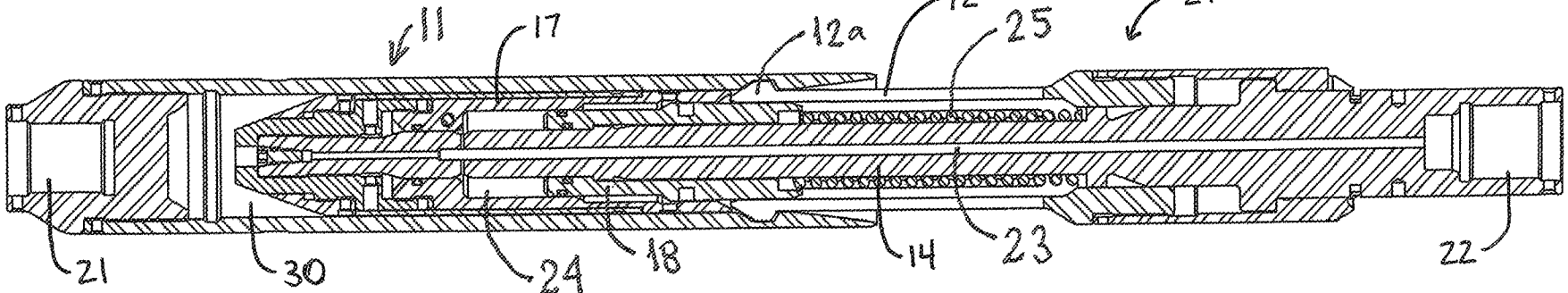
FIG. 2 illustrates a longitudinal, cross-sectional view of a disconnect device according to an embodiment of the present invention in a pressure-actuated state.
Figure 3:
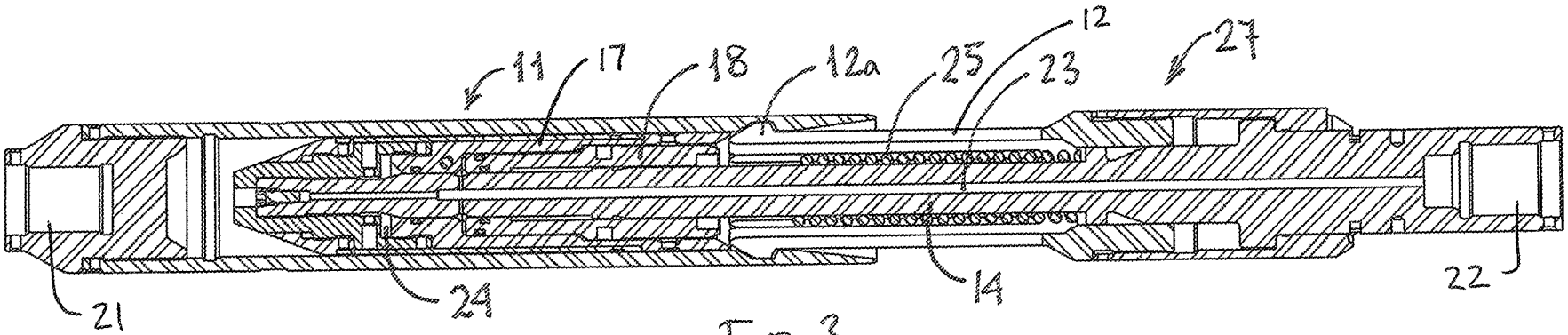
FIG. 3 illustrates a longitudinal, cross-sectional view of a disconnect device according to an embodiment of the present invention in a pressure-released state.

FIGS. 1-3 illustrate an embodiment of a disconnect device 10. In embodiments, disconnect device 10 may comprise two major components: a lower receptacle assembly 11 (illustrated separately in FIG. 4) and an upper assembly 27 (illustrated separately in FIG. 5). These two components may be capable of coupling together and/or decoupling apart from each other by an operator, on command. Further, the two components, lower receptacle assembly 11 and upper assembly 27, may comprise a lower tool adapter 21 and an upper tool adapter 22, respectively, for connecting to various tubing stings and BHAs or tools. As such, disconnect device 10 may be capable of providing a controlled disconnect between workstrings or other tubing strings and various BHAs or tools during oil and/or gas operations. For instance, disconnection may occur between a downhole tool connected to disconnect device 10 by lower tool adapter 21 and a conduit such as, without limitation, a drill pipe, coiled tubing, or wireline with a pump, and a motor connected to upper tool adapter 22. In embodiments, lower receptacle assembly 11 may further comprise a receptacle opening 30, and upper assembly 27 may further comprise a shaft 14, a collet 12, a piston 18, and a cylindrical assembly 17.

FIG. 1 illustrates an embodiment of disconnect device 10 in which lower receptacle assembly 11 and upper assembly 27 may be in an initial coupled state suitable for deployment in a well. Lower receptacle 11 and upper assembly 27 may be initially coupled in any suitable fashion and by any suitable means. For initial coupling, upper assembly 27 may be disposed within receptacle opening 30 and secured in place through the engagement of collet fingers 12*a* and a recess profile 13. In embodiments, collet fingers 12*a* may be radially-outward protrusions on collet 12, while recess profile 13 may be a groove disposed on an inner surface of lower receptacle assembly 11. Engagement of collet fingers 12*a* and recess profile 13 may be accomplished by positioning a piston 18 radially between shaft 14 of upper assembly 27 and collet 12, thus preventing radial collapse of collet fingers 12*a*. In embodiments, piston 18 may be a slidable component within upper assembly 27 that may be radially disposed above shaft 14 and attached to a spring 25. For at least the initial coupling, piston 18 may be secured into place under collet fingers 12*a* via a shear screw attachment 16 to cylindrical assembly 17, such that spring 25 may be partially compressed. In embodiments, this may result in secure connection between lower receptacle assembly 11 and upper assembly 27, and thus may allow for successful deployment of disconnect device 10 and any of its suitable attachments downhole.

After deployment, should an operator need to disengage disconnect device 10, piston 18 may require displacement from its initial fixed position. In embodiments, removal of piston 18 from underneath collet fingers 12*a* may allow collet fingers 12*a* to collapse, and thus disengage with recess profile 13. FIG. 2 illustrates an embodiment of disconnect device 10 in which piston 18 may be in a pressure actuated state that allows for eventual disengagement of lower receptacle assembly 11 and upper assembly 27 after deployment in a well. In embodiments, upper assembly 27 may further comprise fluid passage 23 and pressure chamber 24. Fluid passage 23 may be a borehole disposed within shaft 14, suitable for passing any fluids and/or gases through shaft 14. Pressure chamber 24 may be a chamber located radially between shaft 14 and cylindrical assembly 17, as well as below piston 18. In embodiments, pressure chamber 24 may comprise a pressure tight seal, accomplished via O-ring seals 19 and 20. O-ring seal 19 may be disposed radially between piston 18 and cylindrical assembly 17, and O-ring 20 may be disposed radially between shaft 14 and piston 18. In order to displace piston 18, an operator may apply an actuating pressure within fluid passage 23 and pressure chamber 24 to any suitable level that may be capable of shearing shear screw attachments 16 and displacing piston 18 in an upward direction. In embodiments, shearing shear screw attachments 16 frees piston 18 and allows for movement to a pressure-actuated or second position that may further compress or fully compress spring 25, as well as continue to prevent collet fingers 12*a* from collapsing. Thus, lower receptacle assembly 11 and upper assembly 27 may remain fully engaged in this state.

Figure 4:
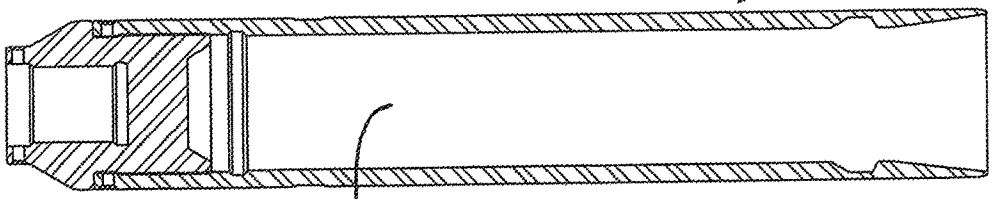
FIG. 4 illustrates a longitudinal, cross-sectional view of a lower receptacle assembly of a disconnect device according to an embodiment of the present invention.
Figure 5:
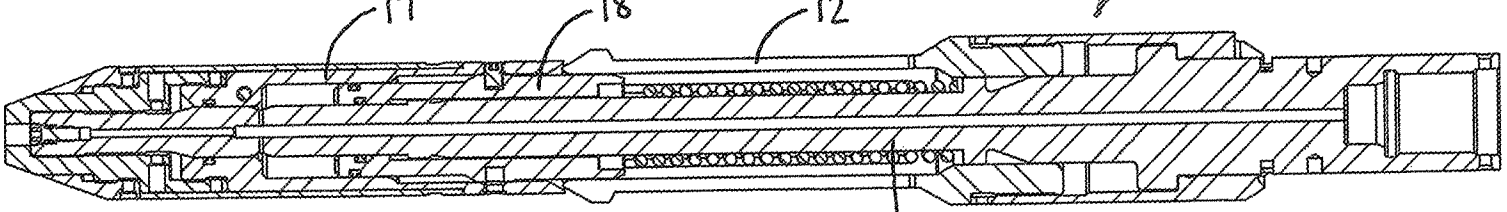
FIG. 5 illustrates a longitudinal, cross-sectional view of an upper assembly of a disconnect device according to an embodiment of the present invention.

After freeing and displacing piston 18 to the pressure-actuated or second position, an operator may fully disengage disconnect device 10 by lowering the pressure levels within pressure chamber 24. In embodiment, lowering the pressure levels may be accomplished by releasing pressure, intentionally or unintentionally, from chamber 24 in any suitable fashion known in the art. The release of pressure in chamber 24 may allow piston 18, aided by the force of decompression of spring 25, to be displaced in a downward direction, diminishing pressure chamber 24. FIG. 3 illustrates an embodiment of disconnect device 10 in which piston 18 may be in a pressure-released state and position that allows for full disengagement of lower receptacle assembly 11 and upper assembly 27 after deployment in a well. In the pressure-released or third position, piston 18 may no longer be radially between shaft 14 and collet fingers 12*a*, but rather radially between shaft 14 and cylindrical assembly 17. This may allow for collet fingers 12*a* to collapse in the radial direction and disengage from recess profile 13, and therefore may allow lower receptacle assembly 11 and upper assembly 27 to disengage from each other or become disconnected by simple over-pull. In embodiments, upon disengagement, upper assembly 27 may be retrieved from a well by any suitable conduit. FIGS. 4 and 5 illustrate an embodiment of lower receptacle assembly 11 and upper assembly 27, respectively, fully disengaged or disconnected.

In embodiments, disconnect device 10 may be utilized for any type of operation performed on an oil and/or gas well. In the case of an operation failure such as, without limitation, a leaking tubular, a malfunctioning pump or motor, or any combinations thereof, disconnect device 10 may be utilized to allow for the problem to be fixed at the surface of an oil and/or gas well. Once fixed, the system, which may be connected to upper assembly 27, may be redeployed in the oil and/or gas well and reconnected to lower receptacle assembly 11. In embodiments, reconnection of disconnect device 10 may be accomplished by stabbing upper assembly 27 into lower receptacle assembly 11, and further, applying pressure in pressure chamber 24. As such, piston 18 may be displaced in an upward direction and positioned radially between shaft 14 and collet fingers 12*a*. Once again, piston 18 may be in the pressure-actuated or second position, as was illustrated in FIG. 2, and disconnect device 10 comprising lower receptacle assembly 11 and upper assembly 27 may be fully engaged.

It should be understood that the drawings and description thereto are not intended to limit the disclosure to the particular form disclosed, but on the contrary, the intention is to cover all modifications, equivalents and alternatives falling within the spirit and scope of the present disclosure.

What is claimed is:

1. A disconnect device for use as part of a downhole assembly in an oil or gas well which comprises:

a lower receptacle assembly comprising a recess profile;

an upper assembly comprising:

a shaft comprising a fluid passage, a collet comprising collet fingers, a piston, a cylinder assembly, a pressure chamber disposed radially between the shaft and the cylinder assembly, and a spring wherein the piston is selectively movable into three positions, wherein the three positions comprise a first position, comprising the piston disposed radially between the shaft and the collet fingers, and wherein the piston is coupled to the cylinder assembly via at least one shear pin.

2. A method for disconnecting a disconnect device for use as part of a downhole assembly in an oil or gas well comprising:

(A) outfitting a downhole assembly with a disconnect device comprising:

a lower receptacle assembly comprising a recess profile; and an upper assembly comprising:

a shaft comprising a fluid passage, a collet comprising collet fingers, a piston, a cylinder assembly, a pressure chamber disposed radially between the shaft and the cylinder assembly, and a spring, wherein the piston is disposed radially between the shaft and the collet such that the collet fingers are engaged with the recess profile, and wherein the piston is coupled to the cylinder assembly via at least one shear pin;

(B) applying an actuating pressure within the fluid passage and the pressure chamber to a pressure level capable of shearing the at least on shear pin to free the piston for displacement;

(C) lowering the pressure level in the pressure chamber by releasing pressure;

(D) allowing the piston to be displace to a position radially between the shaft and the cylinder assembly, wherein the collet fingers are not engaged with the recess profile; and (E) disconnecting the lower receptacle assembly from the upper assembly.

3. The method of claim 2 further comprising reconnecting the lower receptacle assembly and the upper assembly.

4. The method of claim 3, wherein reconnecting the lower receptacle assembly and the upper assembly comprises stabbing the upper assembly into the lower receptacle assembly and applying pressure into pressure chamber.

* * * * *